US005447276A

United States Patent [19]

Aldridge et al.

[11] Patent Number: 5,447,276

[45] Date of Patent: Sep. 5, 1995

[54] CRUSHING MECHANISM

[75] Inventors: Graham J. Aldridge, Silsoe; Harry J. Gilbertson, Greenfield, both of Great Britain

[73] Assignee: The Minister of Agriculture Fisheries and Food in Her Britannic Majesty's Government of the United Kingdom of Great Britain and Northern Ireland, London, England

[21] Appl. No.: 204,232

[22] PCT Filed: Sep. 4, 1992

[86] PCT No.: PCT/GB92/01613

§ 371 Date: May 24, 1994

§ 102(e) Date: May 24, 1994

[87] PCT Pub. No.: WO93/05209

PCT Pub. Date: Mar. 18, 1993

[30] Foreign Application Priority Data

Sep. 5, 1991 [GB] United Kingdom ..... 9118932

[51] Int. Cl.[6] ..... B02C 11/04; B02C 18/18; B02C 18/22

[52] U.S. Cl. ..... 241/79; 241/86; 241/159; 241/222; 241/236; 241/238

[58] Field of Search ..... 241/73, 79, 86, 143, 241/144, 145, 159, 222, 236, 238

[56] References Cited

U.S. PATENT DOCUMENTS

| | | | |
|---|---|---|---|
| 2,930 | 1/1843 | Merry | 241/236 |
| 532,277 | 1/1895 | Johnson | 241/236 X |
| 816,763 | 4/1906 | Trask | 241/159 X |
| 2,121,378 | 6/1938 | Wilkinson et al. | 241/159 X |
| 2,509,148 | 5/1950 | Hurst | 241/159 X |
| 3,155,028 | 11/1964 | Morgenson | 241/238 X |
| 3,801,024 | 4/1974 | Elsner | 241/222 X |
| 4,923,130 | 5/1990 | Campbell | 241/236 |
| 5,217,174 | 6/1993 | Martin et al. | 241/222 |

FOREIGN PATENT DOCUMENTS

| | | | |
|---|---|---|---|
| 0154128 | 9/1985 | European Pat. Off. . | |
| 551711 | 10/1930 | Germany | 241/159 |
| 80514 | 3/1919 | Switzerland | 241/259 |
| 169293 | 9/1921 | United Kingdom . | |
| 232776 | 4/1925 | United Kingdom . | |
| 239495 | 12/1926 | United Kingdom . | |
| 280198 | 5/1928 | United Kingdom . | |
| 316309 | 4/1930 | United Kingdom . | |
| 358833 | 10/1931 | United Kingdom . | |
| 410399 | 5/1934 | United Kingdom . | |
| 596329 | 1/1948 | United Kingdom . | |
| 1158304 | 7/1969 | United Kingdom . | |
| 2053995 | 6/1982 | United Kingdom . | |
| 2163935 | 3/1986 | United Kingdom . | |
| 2195365 | 4/1988 | United Kingdom . | |

OTHER PUBLICATIONS

F. Sass, CH. Bouche: Dubbel's Taschenbuch Fur Den Maschinenbau, Berlin, Gottingen, Heidelberg, 1956, p. 658. (With Translation).

*Primary Examiner*—Timothy V. Eley
*Attorney, Agent, or Firm*—Nixon & Vanderhye

[57] ABSTRACT

According to the present invention a crushing mechanism having at least two pairs of co-acting rollers, each roller having a hub with a plurality of teeth extending from a circumference thereof, the pairs of rollers being mounted in open cage fashion and characterized in that each tooth is, at least at its outermost position, in the form of a flat plate angled relative to a radius of the hub with an edge lying parallel with a roller axis, the rollers at their closest positions having plates on one in spaces between plates in the other, the plates of the at least two pairs of co-acting rollers comprising a means for crushing without scraping material in the crushing mechanism, the angle of each plate is substantially the same angle which would be present on a face of a gear tooth between co-acting rollers having gear teeth for crushing material.

10 Claims, 5 Drawing Sheets

CRUSHING MECHANISM

BACKGROUND OF THE INVENTION

1. Field of the Invention

The present invention relates to crushing mechanisms, for use particularly with decorticating machines such as are used for extracting usable fibre from the stems or leaves of certain plants, such as seed bearing plants, and in particular for the extraction of fibre from seed-flax once the linseed has been removed.

2. Discussion of Prior Art

It has long been known that the flax straw left after removal of seed contains fibres which, when separated from the associated pulp and woody matter, has a variety of uses. For example it can be used in the manufacture of paper, and it can be formed into a felt which might, for example, be used as a carpet backing or might be spun for woven cloth or a wick for soaking up oil. However, known methods of separating the fibre are either labour intensive or relatively inefficient, and as a consequence the flax straw is frequently treated as a waste product to be burned (which in many places is now not approved or is even illegal) or otherwise disposed of. Disposal other than by burning can be difficult as, due to its bulk and the long length it is difficult to chop and incorporate, and may take several years to break down under the action of soil organisms if it is ploughed back into the land.

In a known method of extracting fibres from flax straw the straw is first "retted" in large quantities of water, and is then beaten in a hand driven device to remove the unwanted material, which is known as shiv. This method produces a high quality fibre, but is extremely slow. Mechanized methods are known, as taught, for example, in U.S. Pat. No. 2,121,378 in which straw is passed in series through one or more pairs of crusher rollers, then through a series of decorticating rollers, the diameters of these decreasing in the direction of straw travel, to a pair of delivery rollers and thence through a rotating beater which acts over a grid through which waste material passes to a conveyance pipe, this last part of the process being pneumatically assisted. The various sets of rollers are fluted, and the process of separating fibre from shiv takes place as a result of the straw being, in effect, trapped between a series of interacting gears.

In another mechanical separating machine, described in EP 84302433.2 a similar process takes place in which the straw passes between sets of meshed gear wheels to separate the fibres from the shiv. With this apparatus the straw is to some extent aligned in the direction of travel by passing, prior to the crushing gears, over a grid through which pass spikes mounted on rotating wheels, the speed of rotation of the wheels increasing as the fibres near the crushing gears. A pinned roller (that is a roller from whose surface project a plurality of pins) combs out fibre from the material issuing from the crushing rollers, and this is collected whilst the shiv is led away for separate collection.

In practice these mechanised methods of extracting fibres have proved to have disadvantages, and the fibres produced thereby are held by some skilled in the art to be inferior to those produced by the old fashioned retting and hand operated separating process. There appear to be several reasons for this.

Whilst it appears that aligning the straw before it passes through crushing rollers has a beneficial effect it has been found that in arrangements such as that described in EP 84302433.2 straw tends to ride on top of the spikes rather than allowing the spikes to pass between them. It has also been found that using meshed gears to break down the bond between the fibres and the other material can lead to problems. Shiv breaking away from the fibres tends to clog the gears, and also to jam between adjacent sets of gear wheels so affecting the efficiency of the apparatus or even bringing it to a stop. Also the passage of the straw through the gear wheels has the effect of weakening the fibres so allowing them to become droopy with the result that they tend to droop down into the spaces between adjacent sets of gears, again with a loss of good usable fibres and with the danger of jamming the machinery. Furthermore these known apparatus do not make any provision for adjustment of the quality of the final fibre product to make allowance, for example, for different standards of straw input or for different output requirements such as a requirement for there to be a certain proportion of shiv left with the fibre. When fibre and shiv are delivered directly in the required proportion the distribution thereof is much more even than when an attempt is made to remix fibre and shiv after separation.

There is, therefore, a requirement for an improved machine for producing usable fibre from straw.

CROSS REFERENCE TO RELATED APPLICATION

Our co-pending application U.S. Ser. No. 08/204,222 describes an improved alignment mechanism having a plurality of fingers extending outwardly from a bed plate and mounted so as to be drivable around an endless track in a casing, a driving mechanism including a plurality of pulley mechanisms within the casing extending sequentially along the length of the track, adjacent pulley mechanisms overlapping in side by side relationship, each pulley mechanism having a pulley on which is mounted a plurality of finger drive plates each adapted to contact drive faces attached to the fingers and extending within the casing; and drive means for driving the pulley mechanisms at sequentially increasing speeds such that the fingers can be driven along the length of the bed plate at an accelerating speed.

The finger drive plates are preferably mounted on the pulley in sprag fashion so that when a finger being driven by a first finger drive plate on a particular pulley overtakes a second finger drive plate mounted on a slower pulley it can pass over that finger drive plate which may subsequently take over the drive of the finger as the first finger drive plate is moved out of contact.

The bed plate might be part of the casing, or might be separate from but adjacent to the casing, in which case it might conveniently be in the form of plate material in which there are a plurality of louvered slits.

There will usually be a plurality of tracks and associated series of pulley mechanisms, and alignment may be assisted by having differential finger speeds between inner and outer tracks. Each finger might have spigots attached thereto, the spigots riding in channels either side of a track.

There will conveniently be a crop control plate positioned above the bed plate, and this might have fingers mounted thereon and extending towards the bed plate to assist in alignment of the fibres.

Once aligned, the material can be passed to a crushing mechanism.

SUMMARY OF THE INVENTION

According to the present invention a crushing mechanism having at least two pairs of co-acting rollers, each roller having a hub with a plurality of teeth extending from a circumference thereof, the pairs of rollers being mounted in open cage fashion and characterised in that each tooth is, at least at its outermost position, in the form of a flat plate angled relative to a radius of the hub with its edge lying parallel with a roller axis, the rollers at their closest positions having plates on one in spaces between plates in the other, the angle at which each plate is angled being the angle at which it would lie if it had one face lying along the length of a gear tooth if the teeth were replaced by a corresponding number of gear teeth.

The teeth might be in the form entirely of plates.

Only one of each pair of rollers might be driven, its rotation inducing rotation of the co-acting roller, or each roller might be driven, in which case it might be made possible for the spacing between teeth to be varied when they are acting on material.

The rollers might have their positions variable relative to one another whilst they are acting on material.

A crushing mechanism will preferably have the pairs of co-acting rollers mounted such that a material pathway therethrough is inclined at an angle, which might be substantially 45°.

It will be noted that the space between the teeth of the present invention is much greater than that in geared arrangements, which removes the danger of the mechanism being jammed or its efficiency reduced as a result of shiv collecting therein.

CROSS REFERENCE TO RELATED APPLICATION

The invention might also include an apparatus, as described in our co-pending application U.S. Ser. No. 08/204,234, for separating fibre and shiv, which includes a pinned metering rotor and a pinned final separation rotor adapted to rotate in opposite directions and having fixed bearing locations, the final separation rotor being adjacent a shroud in which are a plurality of slots, and a pinned doffer rotor rotatable in either direction and having a bearing location which is adjustable relative to the separation rotor.

A shell feed is preferably positioned at the junction of the metering rotor and the final separation rotor, the shell feed having surfaces adjacent the rotors curved. This arrangement creates a bending effect on the fibre over the input nose of the shell feed, therefore helping to remove shiv.

BRIEF DESCRIPTION OF THE DRAWINGS

One embodiment of the invention will now be described, by way of example only, with reference to the accompanying diagrammatic drawings, of which

DETAILED DISCUSSION OF PREFERRED EMBODIMENTS

Figures 1, 1A:
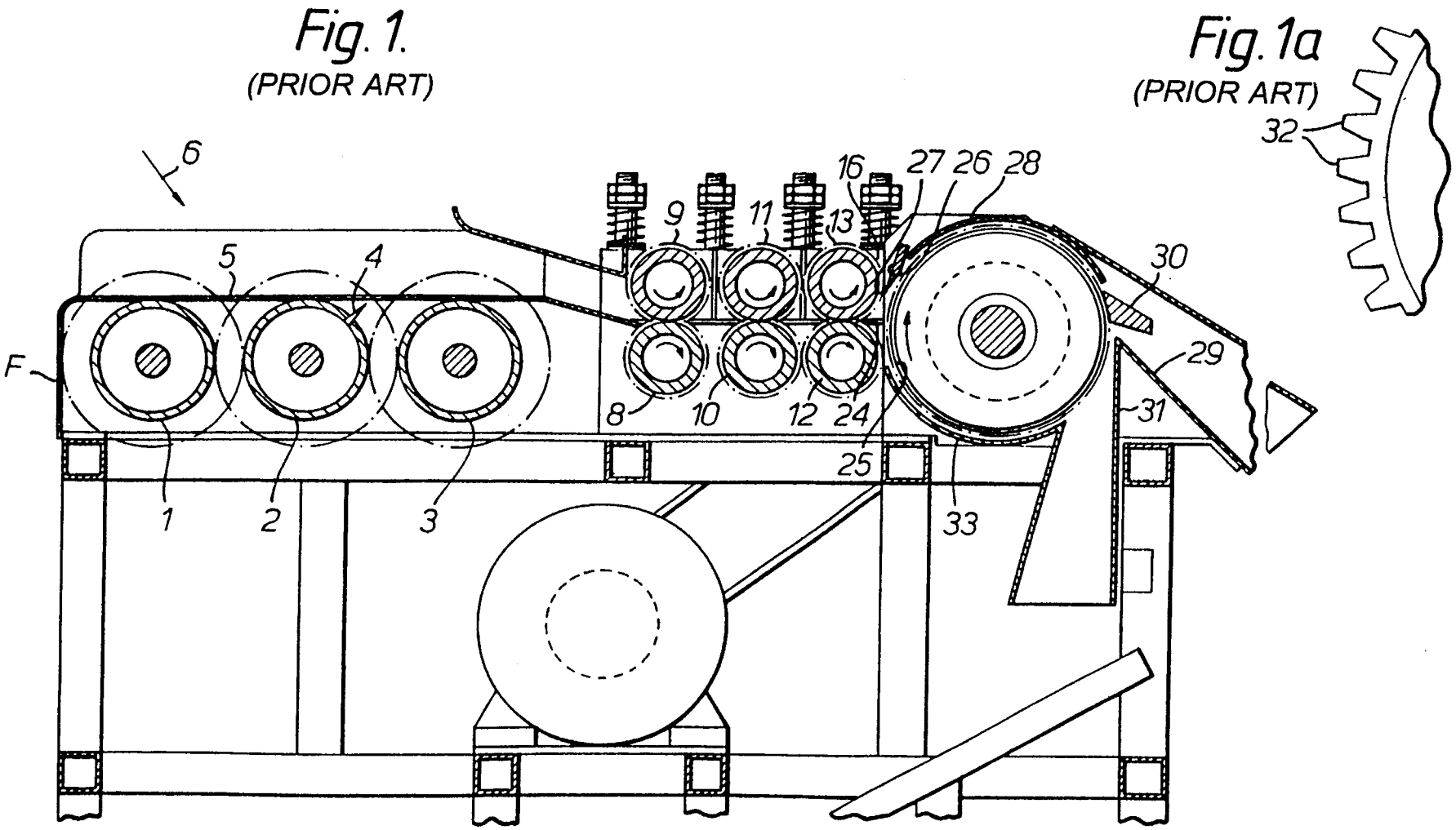
Fig. 1a (PRIOR ART)
Fig. 1. (PRIOR ART)
FIG. 1 is an elevation of the prior art device described in EP 84302433.2.
FIG. 1*a* is a detail of the device of FIG. 1.

As shown in FIG. 1 a prior art device as described in EP 84302433.2 35 has a series of rollers 1,2,3 each having protruding from its circumference a number of spikes such as that shown at 4 which protrude through a slit (not shown) in a surface 5. The surface 5 leads to a series of three co-acting pairs of meshed gear wheels 8,9; 10,11 and 12,13, each gear wheel having a set of gear teeth 32 (FIG. 1*a*) around its circumference. The series of co-acting gear wheels leads to a finely pinned roller 25 via an adjustable blade 26 having a stripping edge 27. A movable baffle 30 is positioned adjacent the roller 25 and chutes 29, 31 lead away from the roller 25.

In operation flax straw is supplied as illustrated at 6 onto the surface 5. The rollers 1,2,3 are rotated, the speed of roller 3 being greater than that of roller 2 which is in turn greater than that of roller 1, and the action of the spikes 4 is intended to align the individual straws with one another and move them forward in turn into the crushing gear wheels 8,9 10,11,12,13. Within these pairs of crushing rollers the shiv is largely detached from the fibre content of the flax straw, and the fibre, still with shiv attached passes to the pinned roller 25 which carries it round until it meets the baffle 30, which lifts off the shiv and conveys it to chute 29, whilst the fibres continue round to be delivered through the chute 31. The quality of fibres produced by this method is high, but difficulties have been experienced with operating the machine. Flax straw delivered at 6 tends to ride on top of the spikes 4 rather than being disentangled and aligned thereby and there is also a tendency for spikes 4 to drag straws down into the slit in platform 5 with consequent danger of weakening or breakage of pins 4, breakage of straws, and hence of the fibres therein and jamming of the machinery. During passage through the crushing rollers 8,9,10,11,12,13 some shiv is detached from the fibres and can either clog the spaces in the gears, resulting in decreased efficiency of the decortication process or damage to fibres, or can indeed jam the rollers causing increased resistance to rotation and even stoppage. Also, weakened fibres tend to droop and be lost into spaces between sets of crushing rollers, with a danger of causing stoppage. Any attempt to overcome this problem by tilting the crushing roller assembly results in increased danger of stoppage caused by build up of shiv between adjacent pairs of rollers. The arrangement of the pinned roller 25 and movable baffle 30 allows only a limited range of adjustment to cope with different standards of, or requirements for the final product.

A machine using the present invention (FIG. 2) has a crop control plate 50 and a crop delivery mechanism 51 which may be, for example, a toothed chain, against which rests a delivery bale 52 of material to be processed. Whilst the delivery bale 52 might be of any shape it is preferably positioned so that the material therein is aligned as closely as possible to the desired final alignment. Material from the bale 52 is delivered to an alignment mechanism 53 which has a plurality of fingers such as those shown at 62 which project through a bed plate 55 and which are adapted in use to move along the length of the bed plate 55 at an accelerating speed. Straw passing along the alignment mechanism is arranged into parallel lines and is then delivered through a pair of feed rollers 56 to an open cage bank 57 of specially designed crushing rollers 58. The bank 57 of rollers 58 is inclined at an angle of about 45° to the horizontal, and fibres (with attached and accompanying shiv) pass from the end of the bank 57 to a separating apparatus 59.

Figure 3:
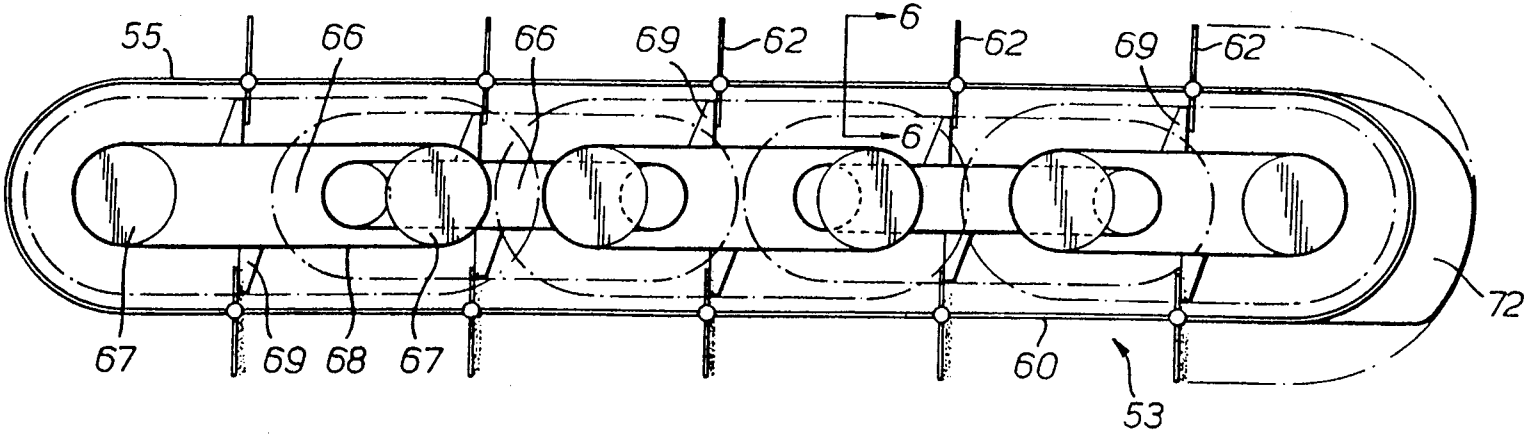
FIG. 3 is an elevation of an alignment mechanism used in the apparatus illustrated in FIG. 2.
Figure 4:
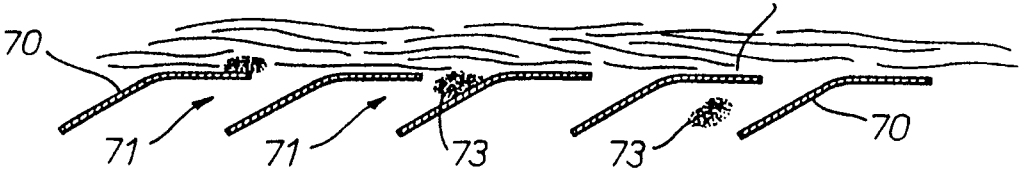
FIG. 4 is a detail of the mechanism illustrated in FIG. 3.
Figure 6:
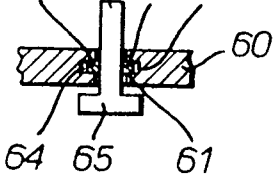
FIG. 6 is an end view in section along lines 6—6 on FIG. 3.
Figure 5:
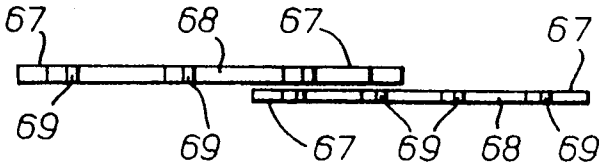
FIG. 5 is a plan view, in detail, of part of the mechanism illustrated in FIG. 3.

The alignment mechanism 53 (FIG. 3) has a casing 60 round which extends at least one endless track 61 (FIG. 6) in which rides a plurality of fingers 62 which extend through the bed plate 55 which might be part of the casing 60 (as shown in FIG. 3) or separate and adjacent the casing 60. When separate from the casing 60 the bed plate might conveniently (FIG. 4) be in the form of plate material 70 in which are formed a plurality of louvered slits 71. Each finger 62 might, for example, have secured thereto spigots 63 which ride in channels 64 leading from the track 61 in the casing 60 and which open onto the track 61 (FIG. 6). Secured to each finger 62 and extending within the casing 60 is a drive face 65. Within the casing 60 and extending sequentially there-along are a plurality of pulley mechanisms 66, with adjacent pulley mechanisms overlapping in side by side relationship as illustrated in FIG. 5. Each pulley mechanism includes a pair of pulley wheels 67 on which are mounted a pulley 68 which may be, for example, a chain, on which are mounted a plurality of finger drive plates such as those shown at 69, these drive plates 69 being preferably mounted in sprag fashion. Each pulley mechanism 66 is connected to a drive means (not shown), which may have a common power source such as an internal combustion engine or electric motor acting through a series of gear boxes. There will normally be a plurality of endless tracks 61, each with its associated fingers 62 and sets of pulley mechanisms 66.

Figure 2:
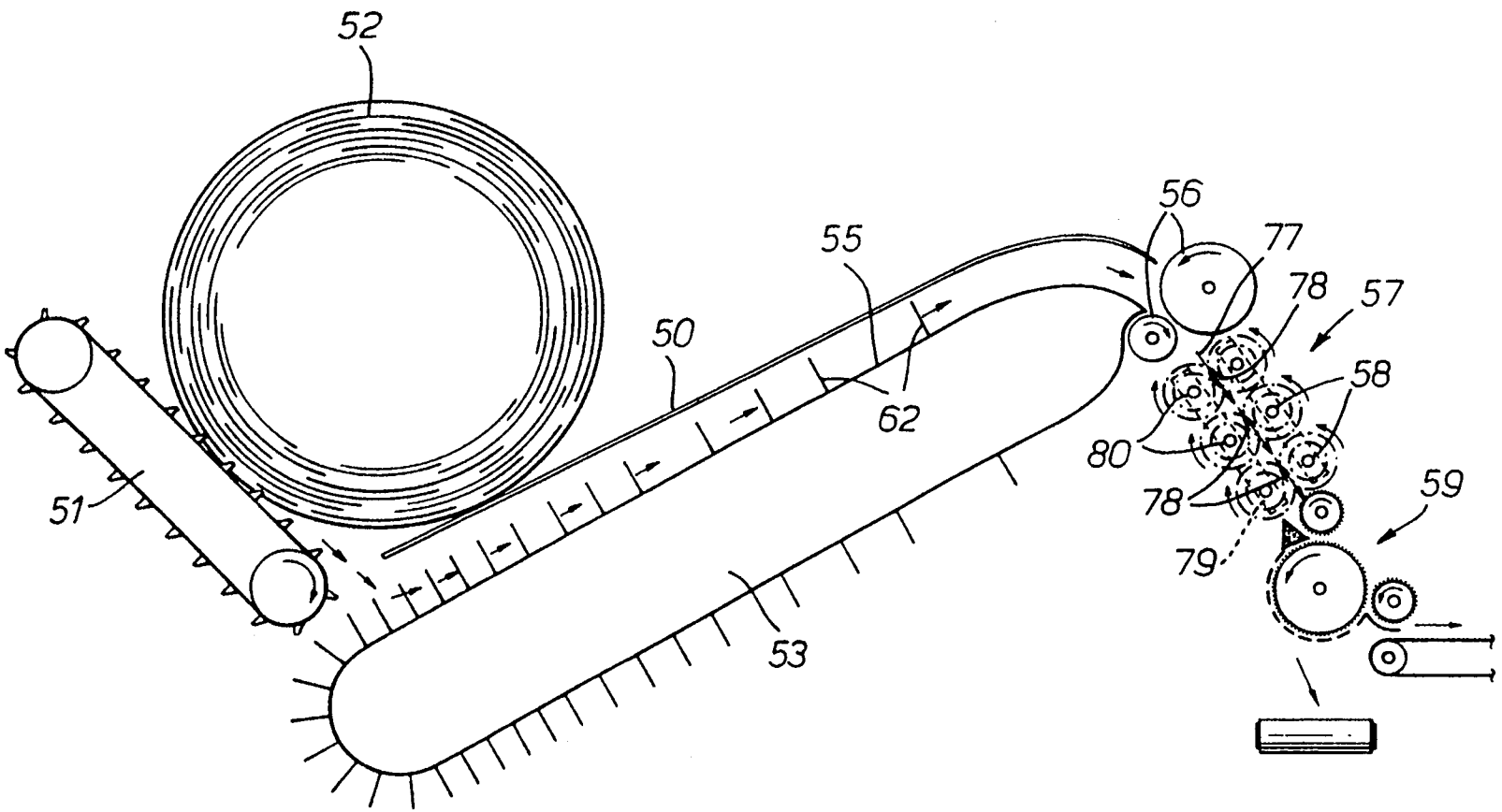
FIG. 2 is an elevation of an apparatus according to the present invention.

In use the alignment mechanism 53 is preferably mounted on the decortication machine inclined upwardly in the direction of straw flow (FIG. 2). The drive mechanism is operated to drive the pulleys 68 at sequentially higher speeds along the length of the casing 60. The finger drive plates 69 act on the drive faces 65 of the fingers 62 driving them along the track 61. As each finger drive plate 69 reaches the end of its particular pulley mechanism it will fall away from the drive face 65 which will be contacted, due to the side by side and overlapping relationship of adjacent pulley mechanisms 66, by finger drive plate 69 on the adjacent and faster moving pulley mechanism 66. At the end of the bed plate 55 the fingers will move away round the end of the casing into a channel formed by an end plate 72. When straw is fed onto the bed plate 55 from the feed mechanism 51 it will be moved there-along and aligned thereon by the action of the accelerating fingers 62. When the bed plate 55 is louvered as shown in FIG. 4 extraneous articles such as stones and dirt will, to a large extent, fall away through the louvres 71. On their return path the fingers 62 will be passed from faster moving to slower moving pulley mechanisms 66, hence the advisability of the sprag mounting of finger drive plates 69 on chains 68.

Additional aligning for straw that lies across the conveyor can be effected by introducing a speed differential between the outer and inner fingers 62; alternatively or additionally fixed fingers could be mounted, for example in a trailing angle mode, on the centre portion of the crop control plate 50.

Figure 7:
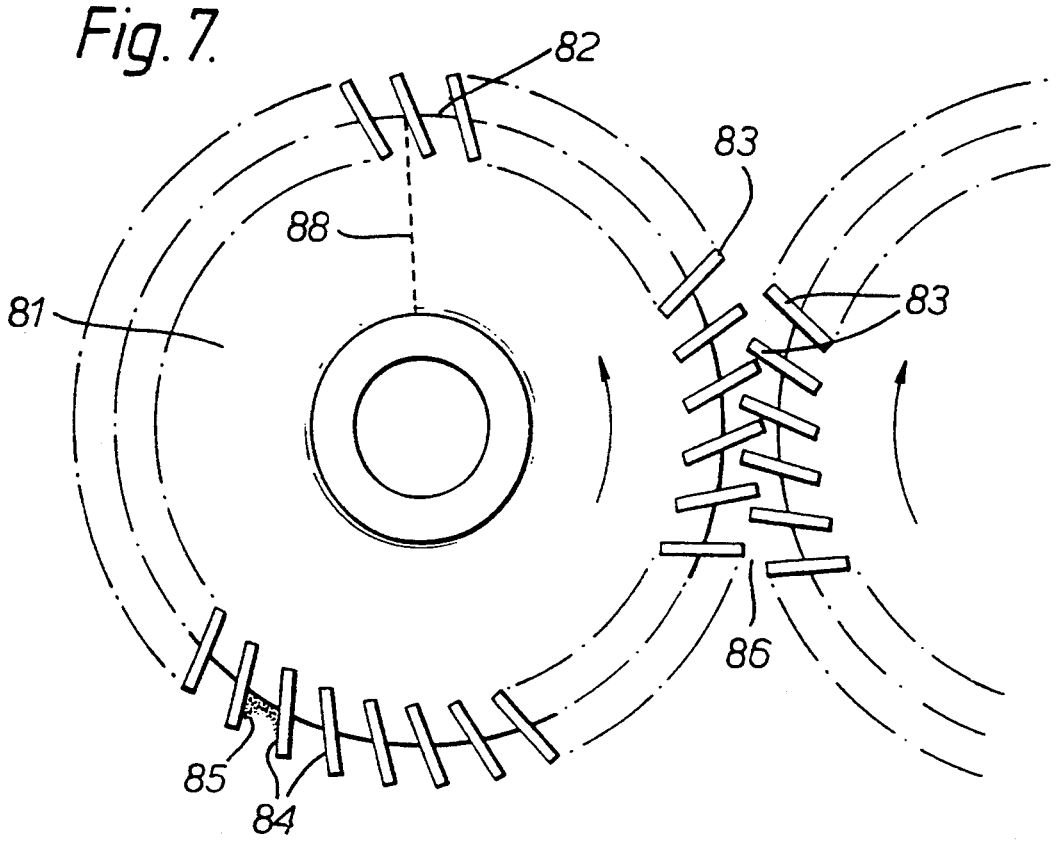
FIG. 7 is an elevation of a roller for use in a crushing mechanism as used in the apparatus of FIG. 2, including a portion of a co-acting roller.
Figure 8:
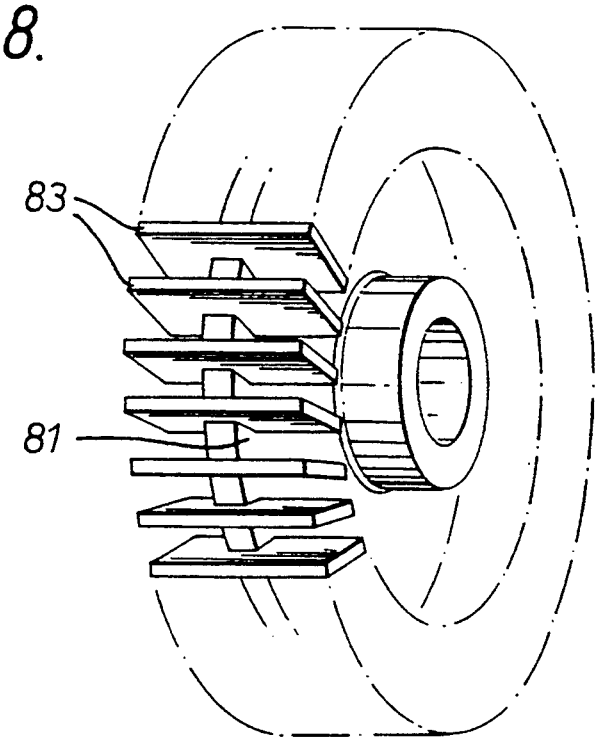
FIG. 8 is a perspective view of the roller illustrated in FIG. 7.

From the alignment mechanism aligned straw is passed (FIG. 2) through the feed rollers 56 to a crushing machine 57 according to the present invention, which contains three pairs 78 of crushing rollers 58 mounted such that a material pathway 77 therethrough is inclined at an angle to the vertical, the angle being, for example, 45°. The crushing rollers 58 are contained in an open cage construction—that is they might, for example, be mounted in a cage comprising only support bars as indicated in dotted lines at 79 in which axles 80 of the crushing rollers 58 are carried. Each crushing roller 58 (FIG. 7, FIG. 8) comprises a hub 81 from the circumference 82 of which projects a plurality of teeth in the form of evenly spaced plates 83, each plate angled relative to a radius 88 of the hub 81, at an angle such that, were the circumference to contain a similar number of gear teeth to the number of plates (83) a relevant side (84) of each plate would be tangential to a gear surface as illustrated at 85 in FIG. 7. With this arrangement straw passing therethrough will be crushed between a tooth face on one roller and a tooth tip on the other roller. Pairs of crushing rollers 58 are positioned adjacent to one another so that the plates 83 thereon overlap as shown at 86 in FIG. 7. Means (not shown) are provided for driving at least one, but preferably both of each pair of crushing rollers 57. When the crushing rollers 58 are driven independently this allows the circumferential relationship of the plates 83, where they overlap, to be adjusted. Similarly the structure (not shown) on which the axles 80 of the crushing rollers 58 are mounted might be made positionally adjustable so that the separation between each pair of crushing rollers 58 can be adjusted.

Figure 9:
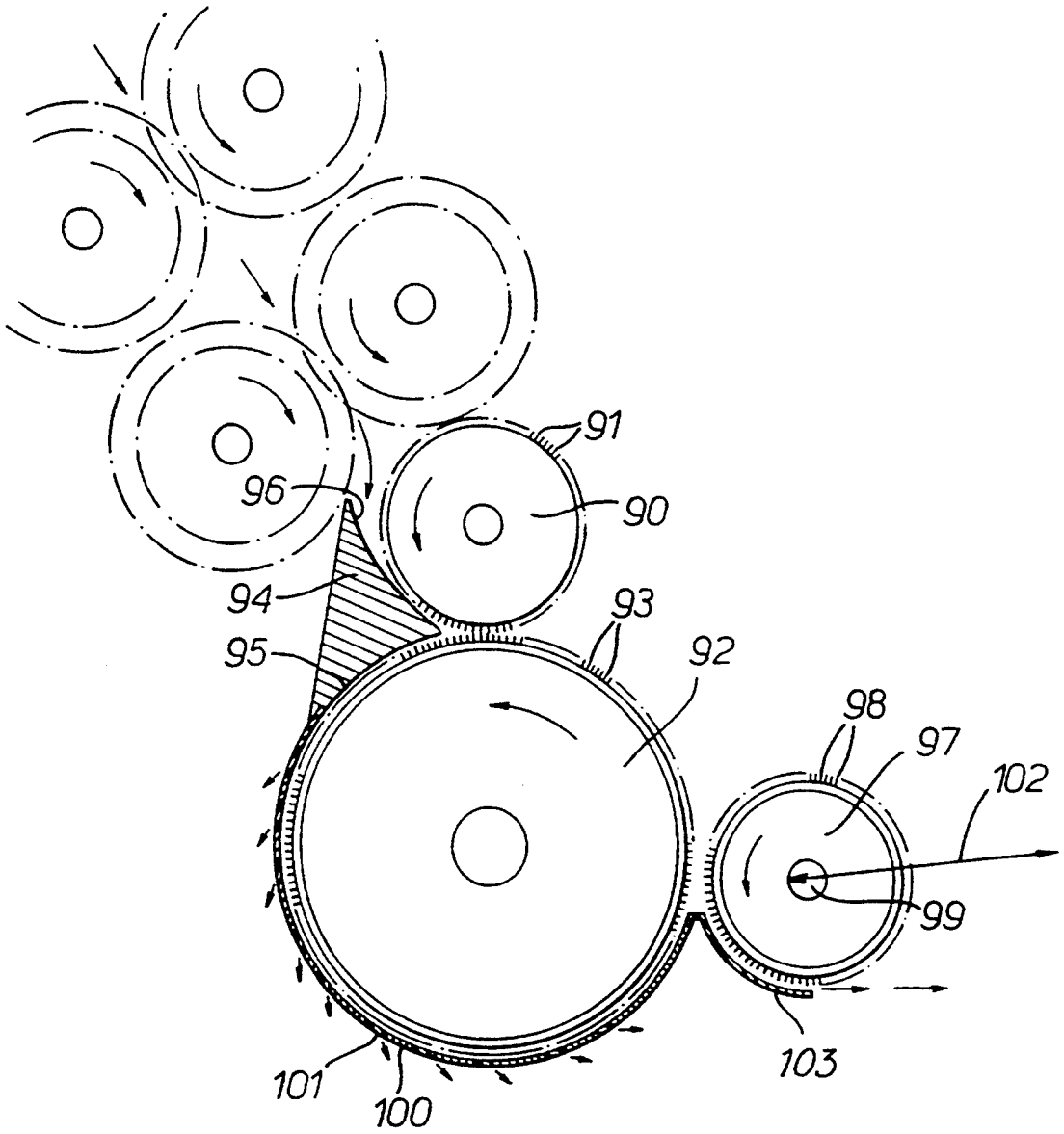
FIG. 9 is an elevation of a separating apparatus as used in the apparatus of FIG. 2.

From the crushing mechanism 57 the straw, which now consists of fibres from which shiv has been detached or loosened, is passed to a separating apparatus 59 (FIG. 9). This consists of a pinned metering roller 90 (having pins 91) situated adjacent to a pinned final separation roller 92 having pins 93. Means are provided (not shown) for driving the rollers 90,92 in opposite directions. A shell feed structure 94 is positioned adjacent the rollers 90,92 and has a first side 95 adjacent to roller 92 and curved so as to be substantially parallel to the surface thereof, whilst the second surface 96 adjacent the metering roller 90 has a curvature somewhat larger than the curvature of the roller 90. A separation shroud 100 having shiv slots 101 extends from the end of the surface 95 circumferentially around, for example, half of the final separation rotor 92, and at the end of the shield 100 is positioned a doffer rotor 97 having pins 98 which has an axle 99 adapted (by means not shown) to be driven in either direction and to be moved, as indicated at 102, to adjust its position relative to the final separation rotor 92. At the conjunction of the rotors 92,97 the shield 100 might conveniently be doubled back on itself as indicated at 103 to lie adjacent the circumference of the doffer rotor 97 when the axle 99 is positioned to bring the rotors 92 and 97 at their closest together position.

In operation the apparatus according to the invention is operated in a very similar manner to the machine illustrated in FIG. 1. Material from the bale 52 (which may be of any shape) is supplied by the mechanism 51 to the grid 70 of a bed plate 55, and then is conveyed there-along and aligned thereon by the accelerating movement of the fingers 62. Loose material 73 such as, for example, stones in the straw will, to some extent at least, be cleared from the straw by falling through the slits 71. The aligned straw is then passed through the feed rollers 56 to the crushing mechanism 57 and is passed there-through with the result that some shiv is separated from the fibre whilst some is broken but remains attached to the fibres. Depending upon the particular arrangements of the crushing mechanism 57 the positions of the crushing rollers 58 might be adjusted to optimise the arrangement to allow For variation in the qualities of material from the bale 52. During this operation a certain amount of shiv will be detached from the fibres, and due to the open cage fabrication of the crushing mechanism 57 this can fall freely away without being trapped between adjacent sets of rollers 58. Likewise, due to the construction of the rollers 58 with plates 83 rather than gears the volume between adjacent plates 83 does not become clogged with detached shiv. Finally the straw, in which any remaining shiv is only loosely attached to the fibres, is passed to the separating mechanism 59. The metering rotor 90 steers the material over the shell feed 94 on to the final separation rotor 92, which steers it round to the doffer rotor 97. During its passage round the final separation rotor 92 most of the shiv is detached through the slots 101 in the shroud 100. The material is then passed to the doffer rotor 97 whose position relative to the final separation rotor 92, and speed and direction of rotation, are adjusted to suit any particular requirements. For example, whilst the machine can advantageously be used to produce fibre almost entirely free of shiv it might at times be required to leave a particular proportion of shiv mixed with the final fibre product. The nature of the materials is such that it is extremely difficult to remix separated shiv and fibre in an even consistency.

What is claimed is:

1. A crushing mechanism having at least two pairs of co-acting rollers each roller having a hub with a plurality of teeth extending from a circumference thereof, the pairs of rollers being mounted in open cage fashion, wherein each tooth having, at least at an outermost position, the form of a fiat plate angled relative to a radius of the hub with an edge laying parallel with a roller axis, the rollers at their closest positions having plates on one in spaces between plates in the other, said plates of said at least two pairs of co-acting rollers comprising a means for crushing without scraping material in said crushing mechanism, said angle of each plate is substantially the same angle which would be present on a face of a gear tooth between co-acting rollers having gear teeth for crushing material.

2. A crushing mechanism as claimed in claim 1 characterised in that the teeth are in the form entirely of plates.

3. A crushing mechanism, as claimed in claim 1 characterised in that only one of each pair of rollers is driven, its rotation inducing rotation of the co-acting roller.

4. A crushing mechanism, as claimed in claim 1 characterised in that each roller is driven.

5. A crushing mechanism as claimed in claim 4 characterised in that the spacing between teeth can be varied when they are acting on material.

6. A crushing mechanism as claimed in claim 4 characterised in that the rollers can have their positions varied relative to one another whilst they are acting on material.

7. A crushing mechanism as claimed in claim 1 characterised in that the pairs of co-acting rollers (58) are mounted such that a material pathway therethrough is inclined at an angle.

8. A crushing mechanism as claimed in claim 7 characterised in that the angle is substantially 45 degrees.

9. A machine containing a crushing mechanism as claimed in claim 8, wherein a fiber and shiv bearing material is delivered to the crushing mechanism by an alignment mechanism including:

a plurality of fingers extending outwardly from a bed plate and mounted so as to be drivable around an endless track in casing, the bed plate being a part of or adjacent to the casing;

a driving mechanism including a plurality of pulley mechanisms within the casing extending sequentially along the length of the track, adjacent pulley mechanisms overlapping in side by side relationship, each pulley mechanism having a pulley on which is mounted a plurality of finger drive plates each adapted to contact drive faces attached to the fingers and extending within the casing; and drive means for driving the pulley mechanisms at sequentially increasing speeds such that the fingers can be driven along the length of the bed plate at an accelerating speed.

10. A machine as claimed in claim 9, wherein fiber and shiv material passes from the crushing mechanism to an apparatus, for separating fiber and shiv, including a pinned metering rotor and a pinned final separation rotor adapted to rotate in opposite directions and having fixed bearing locations, the final separation rotor being adjacent a shroud in which are a plurality of slots, and a pinned doffer rotor rotatable in at least one direction and having a beating location which is adjustable relative to the final separation rotor.

* * * * *